US005839291A

United States Patent [19]

Chang

[11] Patent Number: 5,839,291

[45] Date of Patent: Nov. 24, 1998

[54] BEVERAGE COOLING AND DISPENSING SYSTEM WITH DIAGNOSTICS

[75] Inventor: Zhihong (Zachary) Chang, Ballwin, Mo.

[73] Assignee: Multiplex Company, Inc., St. Louis, Mo.

[21] Appl. No.: 696,491

[22] Filed: Aug. 14, 1996

[51] Int. Cl.[6] ..... F25B 49/02

[52] U.S. Cl. ..... 62/126; 62/127; 62/393

[58] Field of Search ..... 62/126, 127, 129, 62/389, 390, 392, 394, 393

[56] References Cited

U.S. PATENT DOCUMENTS

| | | | |
|---|---|---|---|
| 3,940,019 | 2/1976 | Kross et al. | 222/30 |
| 4,140,245 | 2/1979 | Castillo | 222/56 |
| 4,189,067 | 2/1980 | Nottke et al. | 222/57 |
| 4,426,851 | 1/1984 | Neumann | 62/126 |
| 4,467,222 | 8/1984 | Gross et al. | 307/115 |
| 4,487,333 | 12/1984 | Pounder et al. | 222/54 |
| 4,514,724 | 4/1985 | Valentine | 62/129 X |
| 4,518,101 | 5/1985 | Robinson | 222/1 |
| 4,632,275 | 12/1986 | Parks | 222/25 |
| 4,645,095 | 2/1987 | Coppola | 222/64 |
| 4,668,948 | 5/1987 | Merkel | 340/825.3 |
| 4,717,045 | 1/1988 | Coppola | 222/64 |
| 4,728,005 | 3/1988 | Jacobs et al. | 222/64 |
| 4,823,987 | 4/1989 | Switall | 222/63 |
| 4,860,923 | 8/1989 | Kirschner et al. | 222/1 |
| 4,886,190 | 12/1989 | Kirschner et al. | 222/57 |
| 4,903,862 | 2/1990 | Shannon et al. | 222/54 |
| 4,921,134 | 5/1990 | Aschberger et al. | 222/64 |
| 4,938,030 | 7/1990 | Josten et al. | 62/126 |
| 4,967,932 | 11/1990 | Wiley et al. | 222/1 |
| 4,969,576 | 11/1990 | Merrill et al. | 222/1 |
| 5,033,645 | 7/1991 | Shannon et al. | 222/61 |
| 5,082,143 | 1/1992 | Schramm, Jr. | 222/66 |
| 5,102,011 | 4/1992 | Whigham et al. | 222/1 |
| 5,139,708 | 8/1992 | Scott | 261/23.1 |
| 5,141,130 | 8/1992 | Wiley et al. | 222/1 |
| 5,363,671 | 11/1994 | Forsythe et al. | 62/197 |
| 5,417,346 | 5/1995 | Ferri, Jr. et al. | 222/61 |
| 5,433,967 | 7/1995 | Kateman et al. | 426/565 |

*Primary Examiner*—Harry B. Tanner

*Attorney, Agent, or Firm*—Senniger, Powers, Leavitt & Roedel

[57] ABSTRACT

A cooling/dispensing system for cooling and dispensing a beverage. A refrigeration system having an evaporator in a cooling tank cools the fluid in the tank and has a compressor connected to the evaporator for cooling the evaporator. A beverage dispensing system includes a carbonator tank in heat exchange relationship with the fluid in the cooling tank, the carbonator having a first input port connected to a gas supply, having a second input port connected to a liquid supply and having a output port, the carbonator for carbonating the liquid from the liquid supply flowing through the carbonator to produce a carbonated liquid product. A dispenser dispenses the beverage and a beverage conduit connected to the output of the carbonator and connected to the dispenser provides the carbonated liquid product to be dispensed as the beverage. A condition sensor senses a condition of the refrigeration system or of the beverage dispensing apparatus. A controller responsive to the condition sensor controls operation of the refrigeration system and the beverage dispensing system during periods when the condition sensor indicates that the sensed condition is acceptable, the controller inhibiting operation of the refrigeration system and the beverage dispensing system during periods when the condition sensor indicates that the sensed condition is unacceptable. A diagnostic message display connected to the controller displays an error message when a sensed condition is unacceptable.

20 Claims, 11 Drawing Sheets

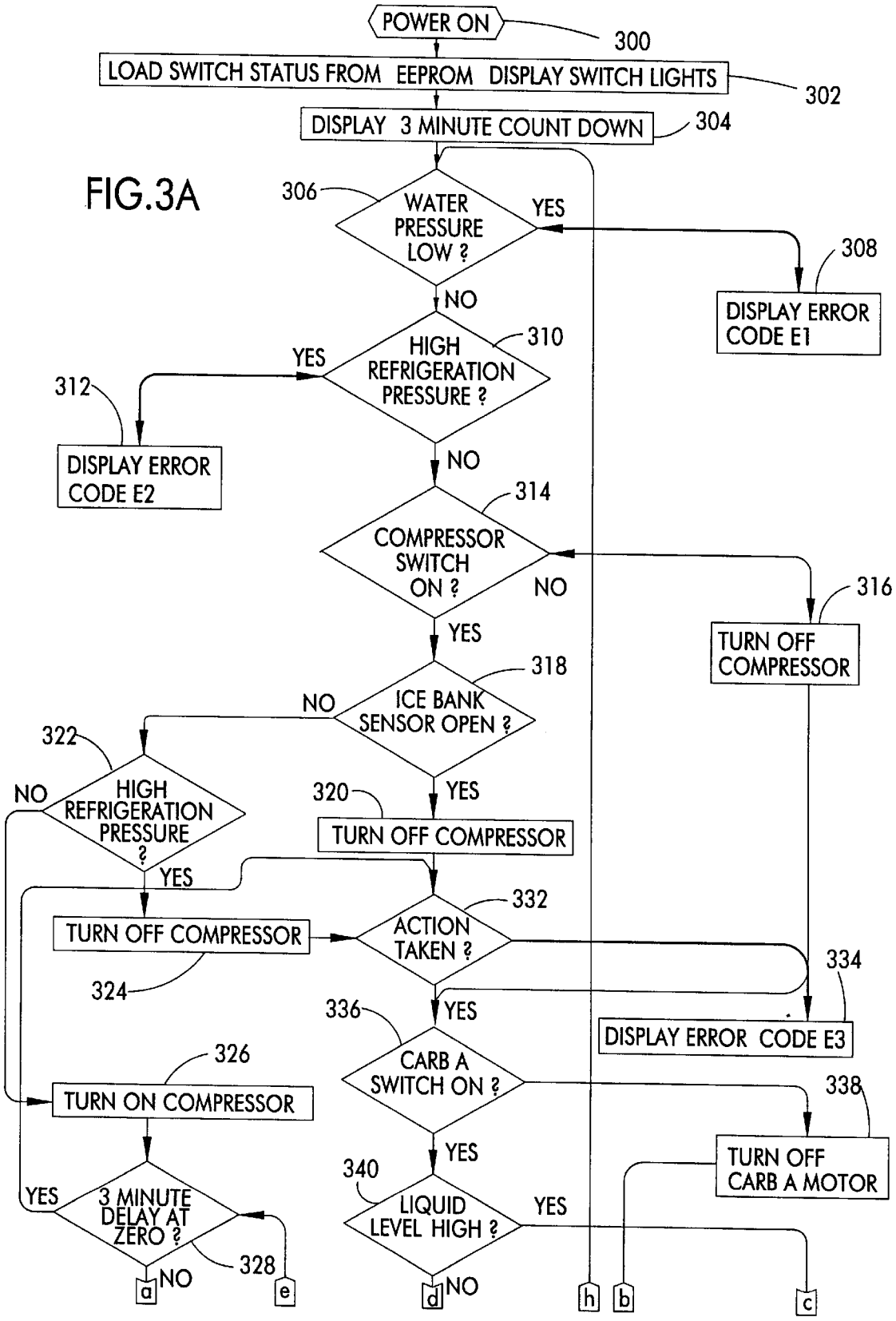
FIG.3A
POWER ON
300
LOAD SWITCH STATUS FROM EEPROM DISPLAY SWITCH LIGHTS
302
DISPLAY 3 MINUTE COUNT DOWN
304
306
WATER PRESSURE LOW ?
YES
308
DISPLAY ERROR CODE E1
NO
310
HIGH REFRIGERATION PRESSURE ?
YES
312
DISPLAY ERROR CODE E2
NO
314
COMPRESSOR SWITCH ON ?
NO
316
TURN OFF COMPRESSOR
YES
318
ICE BANK SENSOR OPEN ?
NO
322
HIGH REFRIGERATION PRESSURE ?
NO
320
YES
TURN OFF COMPRESSOR
YES
332
TURN OFF COMPRESSOR
ACTION TAKEN ?
324
334
336
YES
DISPLAY ERROR CODE E3
326
CARB A SWITCH ON ?
338
TURN ON COMPRESSOR
YES
TURN OFF CARB A MOTOR
340
YES
3 MINUTE DELAY AT ZERO ?
LIQUID LEVEL HIGH ?
YES
328
NO
a
e
NO
d
h
b
c

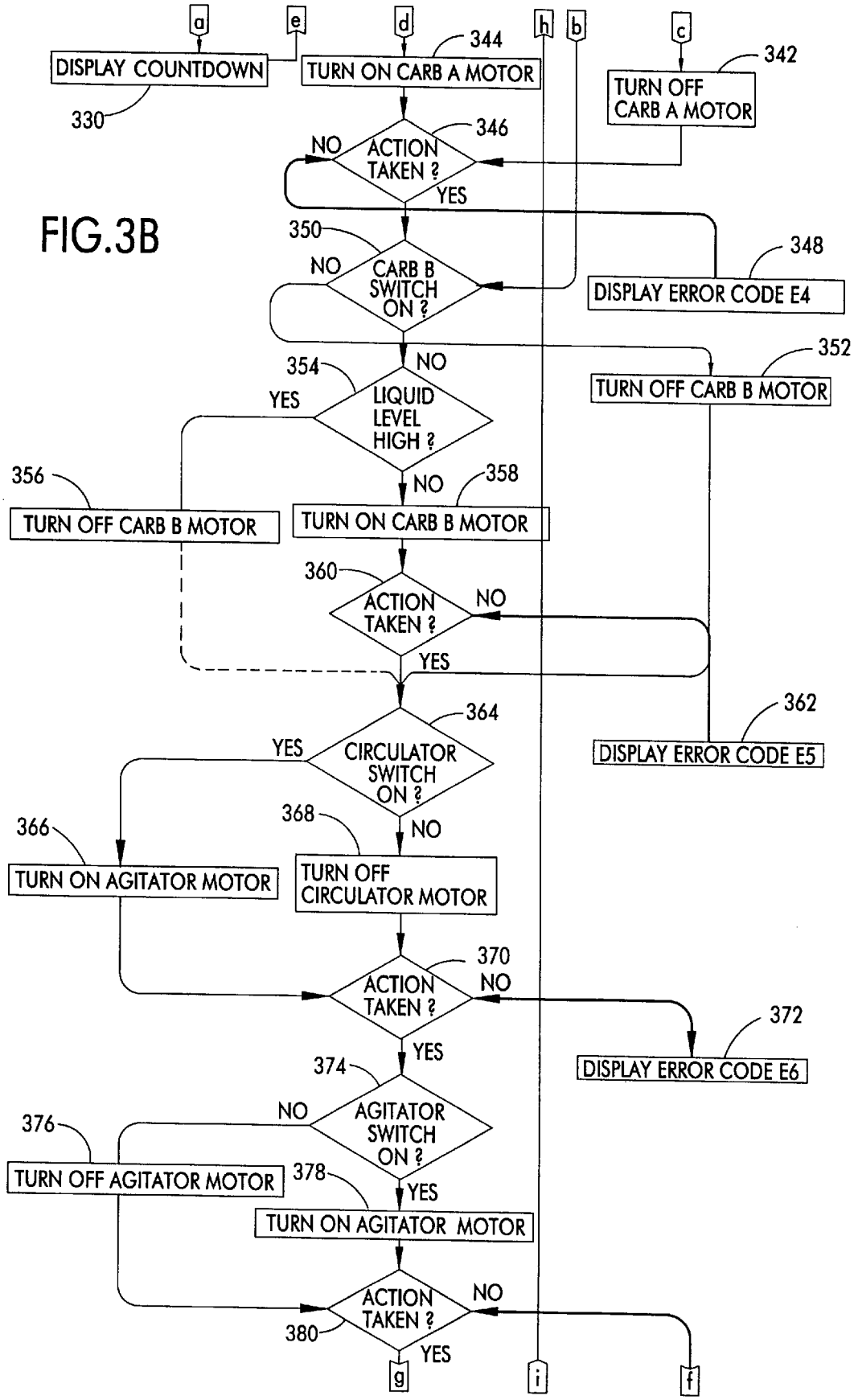
FIG.3B
a
e
d
h
b
c
DISPLAY COUNTDOWN
330
TURN ON CARB A MOTOR
344
TURN OFF CARB A MOTOR
342
ACTION TAKEN ?
346
NO
YES
CARB B SWITCH ON ?
350
NO
DISPLAY ERROR CODE E4
348
TURN OFF CARB B MOTOR
352
LIQUID LEVEL HIGH ?
354
YES
NO
TURN OFF CARB B MOTOR
356
TURN ON CARB B MOTOR
358
ACTION TAKEN ?
360
NO
YES
CIRCULATOR SWITCH ON ?
364
YES
NO
DISPLAY ERROR CODE E5
362
TURN ON AGITATOR MOTOR
366
TURN OFF CIRCULATOR MOTOR
368
ACTION TAKEN ?
370
NO
YES
DISPLAY ERROR CODE E6
372
AGITATOR SWITCH ON ?
374
NO
YES
TURN OFF AGITATOR MOTOR
376
TURN ON AGITATOR MOTOR
378
ACTION TAKEN ?
380
NO
YES
g
i
f

BEVERAGE COOLING AND DISPENSING SYSTEM WITH DIAGNOSTICS

BACKGROUND OF THE INVENTION

The present invention relates generally to beverage cooling and dispensing systems, and more particularly to such systems which use sensors and switches to sense various conditions of the system and control it in response thereto.

Beverage cooling and dispensing systems are well known and used by various beverage retailers such as restaurants. In the event a system malfunctions or is not operating in accordance with normal operating procedures, a service representative must travel to the site of the beverage cooling and dispensing system for repair. Once there, he must first determine the problem with the system. Possible problems could be the compressor, carbonator pump, circulator pump, agitator, or water or refrigeration pressure. Once the problem is determined, the service representative proceeds to repair the system. However, often the service representative does not have the correct parts with him to correct the determined problem. Therefore, he must make a second service call after he gets the necessary parts. The time required to troubleshoot the system and the time required for the second service call cause undesirable down time of the beverage cooling and dispensing system.

SUMMARY OF THE INVENTION

It is an object of this invention to provide a beverage cooling and dispensing system which reduces the need for two service calls and the time it takes to troubleshoot the system when the system malfunctions or is not operating properly. The system has various sensors and switches which monitor the operation of the system and control it in response to the readings from the sensors and the status of the switches. In the event that the system is not operating in accordance with normal operating procedures or within normal ranges, the controller automatically shuts down the system and displays an error signal indicating the particular problem on a diagnostic message display. In effect, this error signal is a self-diagnostic. In the event of a malfunction or improper operation, the system's operator can tell the service representative which error code is displayed before the service representative makes his service call. The service representative is then able to bring the parts necessary to correct the problem associated with that particular error code. This will reduce (and possibly eliminate) the need for two service calls. The displayed error code will also reduce the time it takes the service representative to troubleshoot the system because it will alert the service representative of the problem or of the area where the problem is located. The reduction in the amount of time required to troubleshoot the system and the time required to get correct parts effectively reduces the amount of time the system is down or inoperable.

The system includes switches for monitoring the status of the compressor, carbonator pump, circulator pump and agitator. In addition, liquid level sensors, an ice bank thickness sensor, a supply water pressure sensor, and a refrigeration pressure sensor are included to provide inputs to a microprocessor which controls the operation of the beverage cooling and dispensing system. In response to the various status of the switches and the signals from the sensors, the microprocessor controls operation of the compressor, carbonator pump, circulator pump and agitator and will only permit their sequential and continuous operation when all switches and sensors indicate that the system is operating properly.

Other objects and features will be in part apparent and in part pointed out hereinafter.

BRIEF DESCRIPTION OF THE DRAWINGS

FIGS. 3A, 3B and 3C are a flow chart illustrating operation of the beverage cooling and dispensing system with diagnostics according to the invention.

DESCRIPTION OF THE PREFERRED EMBODIMENTS

Figure 1:
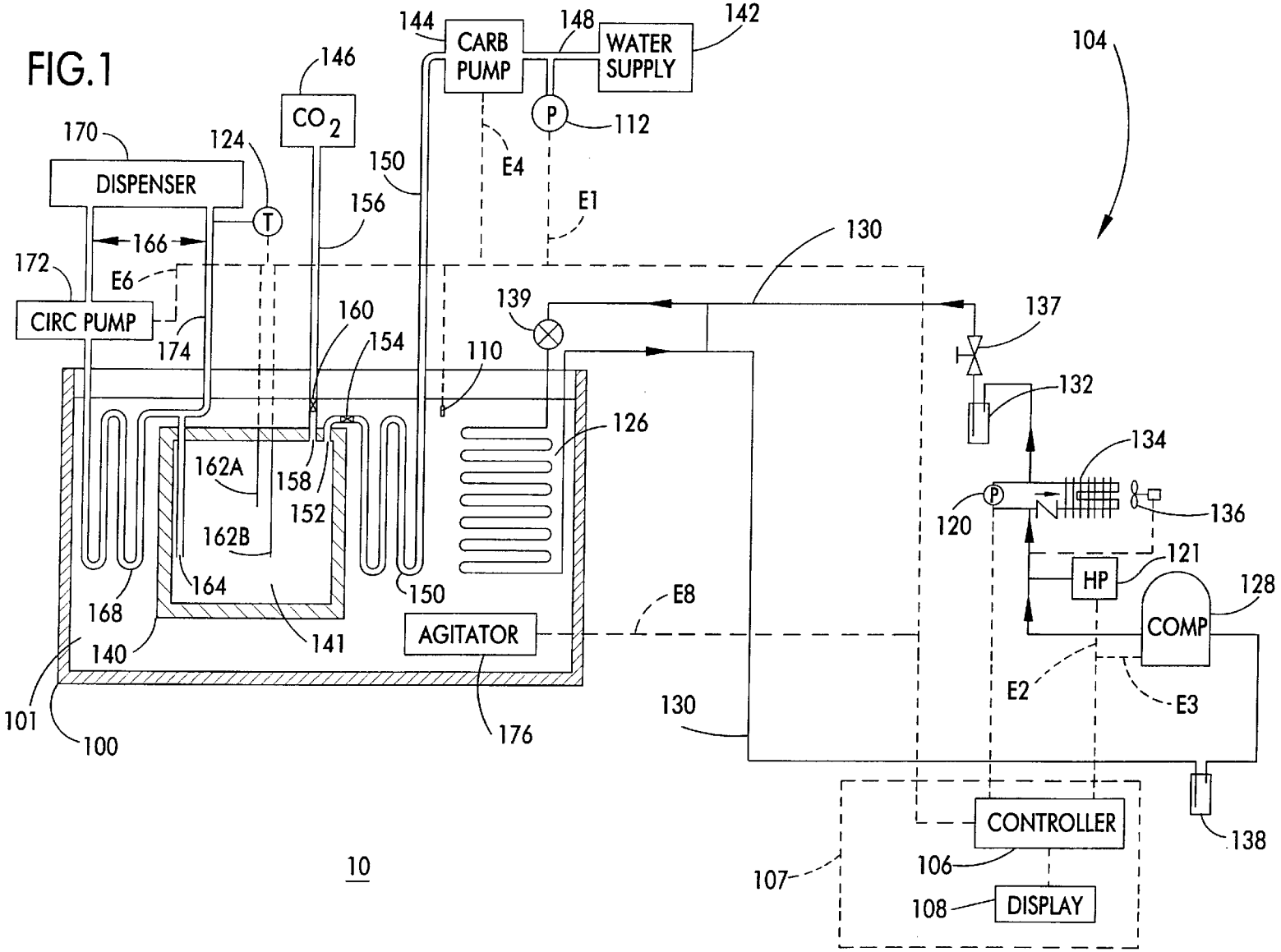
FIG. 1 is a schematic drawing of a beverage cooling and dispensing system with diagnostics according to the invention.

Referring now to the drawings, FIG. 1 illustrates schematically a system 10 of the present invention. The system 10 comprises a cooling tank 100 for holding a cooling fluid 101 such as water, a beverage dispensing system 102, a refrigeration system 104, a controller 106, a diagnostic message display 108, and any one or more sensors 110, 112, 114, 116, 118, 120, 121, 122, 124 for sensing a condition of system 10. Preferably, the controller 106 and display 108 are enclosed in a water resistant enclosure 107 such a cabinet which is rated NEMA 3. This allows convenient cleaning of the system without shorting out the controller or display. The dashed lines in FIG. 1 represent electrical communication lines. Multiple electrical communication lines may be represented by a dashed line. The single solid lines represent refrigerant lines or conduits and the parallel lines represent tubing-like conduits for transporting beverage fluids such as water, gas, or carbonated beverages.

Controller 106 connects to and controls refrigeration system 104 and beverage dispensing system 102. Controller 106 responds to any one or more of sensors 110, 112, 114, 116, 118, 120, 121, 122, 124 for sensing a condition of system 10. Sensors 114, 116, 118 and 122 are located on the driver modules and sense the voltage applied to the motor which verifies driver operation. When responding to one sensor, the controller 106 enables operation of refrigeration system 104 and/or beverage dispensing system 102 during periods when the sensor indicates that the sensed condition is acceptable and the controller 106 inhibits operation of refrigeration system 104 and/or beverage dispensing system 102 during periods when the sensor indicates that the sensed condition is unacceptable. When responding to a plurality of sensors, the controller 106 enables operation of refrigeration system 104 and/or beverage dispensing system 102 during periods when all of the sensors indicate that the sensed conditions are acceptable and the controller 106 inhibits operation of refrigeration system 104 and/or beverage dispensing system 102 during periods when any of the sensors indicate that the sensed condition(s) are unacceptable. A diagnostic message display 108 connected to controller 106 displays an error code when any one or more of the sensed conditions is unacceptable. The following table displays the error codes for the corresponding unacceptable conditions sensed by the corresponding sensors:

| ERROR | SENSOR(S) | CONDITION |
|---|---|---|
| E1 | 112 | LOW WATER SUPPLY PRESSURE |
| E2 | 121 | HIGH REFRIGERATION PRESSURE |
| E3 | 122 | COMPRESSOR DRIVER NOT OPERATING |
| E4 | 114A | CARBONATOR PUMP A DRIVER NOT OPERATING |
| E5 | 114B | CARBONATOR PUMP B DRIVER NOT OPERATING |
| E6 | 116A | CIRCULATOR PUMP A DRIVER NOT OPERATING |
| E7 | 116B | CIRCULATOR PUMP B DRIVER NOT OPERATING |
| E8 | 118 | AGITATOR DRIVER NOT OPERATING |

FIG. 1 illustrates a single carbonator pump 144 having a conductivity sensor 114 which is supplied with a voltage when the pump is operating and having a single circulator pump 172 having temperature sensor 116. It is contemplated that system 10 may include dual dispensing loops A and B having two carbonator pumps 144A and 144B having sensors 114A and 114B, respectively, and two circulator pumps 172A and 172B having sensors 116A and 116B, respectively.

The refrigeration system 104, such as refrigeration system disclosed in Forsythe et al. U.S. Pat. No. 5,363,671, incorporated herein by reference, includes an evaporator 126 in the form of a coil in contact with a cooling fluid 101 for maintaining the fluid 101 at approximately 32° F. (0° C.). A compressor 128 connected to the evaporator 126 by refrigerant lines 130 cools the evaporator. The refrigeration system 104 further includes a refrigerant receiver 132, a condenser 134, a condenser fan 136, a refrigerant accumulator 138, and other components of a refrigeration system as known in the prior art. Refrigerant lines or conduits 130 connect compressor 128 and evaporator 126 for flow of refrigerant from the compressor to the evaporator and back to the compressor to effect the refrigeration cycle. An expansion valve 139, also located in the inlet refrigerant line upstream from the evaporator 126, regulates the flow of refrigerant to the evaporator. Expansion valve 139 may be a thermal/electronic expansion valve as is known in the prior art. It is understood that refrigeration systems of other configurations may be used in place of refrigeration system 104.

As the cooling fluid 101 is chilled, a coating of ice forms on the evaporator 126 (referred to as an "ice bank"). An ice bank thickness sensor 110, connected to controller 106 and located in cooling fluid 101 adjacent evaporator 126, senses the thickness of the ice bank. Ice bank thickness sensor 110 provides a signal to controller 106 representative of the ice bank thickness. When the ice bank thickness sensor 110 indicates that the build-up of ice on evaporator 126 reaches or exceeds a predetermined thickness, ice bank thickness sensor 110 generates a signal to controller 106 to turn off the compressor 128. Ice bank thickness sensor 110 senses when the ice bank thickness decreases to a predetermined thickness and generates a signal to controller 106 to turn on the compressor 128.

A pressure sensor 120, connected to controller 106 and located at condenser 134, senses the refrigeration pressure. Pressure sensor 120 indicates the refrigeration pressure at all times and generates a signal representative of the refrigeration pressure to controller 106. Controller 106 compares the signal from pressure sensor 120 with a reference signal which indicates a predetermined maximum (or minimum or both) acceptable pressure. When pressure sensor 120 indicates that the refrigeration pressure is above (or below) the acceptable pressure, controller 106 discontinues operation of refrigeration system 104. Controller 106 controls the diagnostic message display 108 to display an error code E2 indicating that the refrigeration pressure is unacceptable. A pressure sensor 121 shows an alternative location for pressure sensor 120.

A compressor sensor 122 which senses voltage supplied from the driver to the compressor is connected to controller 106 and is located at driver module 204. Compressor sensor 122 generates a signal to controller 106 indicating the operation of the driver. When compressor sensor 122 indicates the inoperation or improper operation of driver, the controller 106 display the error code. In particular, controller 106 causes diagnostic message display 108 to display an error code E3 indicating the improper operation of driver.

The beverage dispensing system 102 includes a carbonator 140 including a carbonator tank 141 connected to a water supply 142 (via a carbonator pump 144) and a carbon dioxide ($CO_2$) gas supply 146 for supplying $CO_2$ gas to carbonate water from water supply 142 in carbonator tank 141. The carbonator tank 141 is in heat exchange relationship with and preferably immersed in the cooling fluid 101. A water conduit 148 connects the water supply 142 and supplies water to the carbonator pump 144. A water conduit 150, having a section of serpentine configuration immersed in cooling fluid 101 for the purpose of chilling water flowing through water conduit 150, connects the carbonator pump 144 to the carbonator tank 141.

Water from the water supply 142 feeds the carbonator pump 144 and is pumped under pressure from pump 144 through the water conduit 150 (where it is chilled) to a first input port 152 at the carbonator tank 141. A double check valve 154 located at the first input port 152 prevents $CO_2$ gas from leaving carbonator tank 141 through the first input port 152 and permits chilled water to flow from the carbonator pump 144 into the carbonator tank 141. $CO_2$ gas proceeds through a gas conduit 156 to a second input port 158 at the carbonator tank 141. A single check valve 160 at the second input port 158 prevents carbonated liquid from backing into gas supply 146.

$CO_2$ gas from $CO_2$ gas supply 146 passes through the single check valve 160 and pressurizes the carbonator tank 141 with $CO_2$. The $CO_2$ is regulated at a higher pressure (approximately 90 psig (6.3 bar)) than the water from water supply 142 (approximately 55 psig (3.9 bar)), and therefore, when carbonator pump 144 is off, the higher $CO_2$ pressure within carbonator tank 141 prevents the water from water supply 142 from entering the carbonator tank 141.

The carbonator tank 141 contains a liquid level sensing device such as two electrodes, a high electrode 162A and a low electrode 162B, supported by and projecting downwardly from the top of the carbonator tank 141, for detecting the level of carbonated water in the carbonator tank 141. The electrodes 162A and 162B also connect to the controller 106 forming an electrode circuit having three terminals: a high electrode terminal, a low electrode terminal, and a ground terminal connected to tank 140. The carbonated water acts as a conductor to close the circuit between the low electrode terminal and the ground terminal when the carbonated water contacts the low electrode 162B and tank 140. The circuit opens when the carbonated water falls below the low electrode 162B. Similarly, the circuit between the high electrode terminal and the ground terminal closes when the carbonated water contacts the high electrode 162A and tank 140 and the circuit opens when the carbonated water falls below the high electrode 162A. If carbonated water is touching both the low electrode 162B and the high electrode 162A, the controller 106 will not supply power to the carbonator pump 144. When carbonated water is drawn out of carbonator tank 141, it will first fall below the high electrode 162A. This opens the circuit between the ground terminal and the high electrode terminal of the electrode circuit. The continued draw of carbonated water from the carbonator tank 141 could cause the level of carbonated water to fall below the low electrode 162B. This opens the circuit between the ground terminal and low electrode terminal of the electrode circuit. With both circuits open, the controller 106 turns on the carbonator pump 144 to increase the water pressure to a pressure higher than the $CO_2$ pressure (approximately 140 to 170 psig (10 to 12 bar)). The pressurized water overcomes the $CO_2$ pressure within carbonator tank 141 to force water to flow through the double check valve 154. The pressurized water is broken into tiny droplets and sprayed into carbonator tank 141 absorbing $CO_2$ to produce carbonated water. The carbonated water level quickly rises to the low electrode 162B and closes the circuit between the ground terminal and low electrode terminal of the electrode circuit. The carbonated water level continues to rise to the high electrode 162A and closes the circuit between the ground terminal and the high electrode terminals of the electrode circuit. With both circuits closed, the controller turns the carbonator pump 144 off and stops water from being pumped into the carbonator tank 141. In summary, continuity through the carbonated water between both electrode terminals (low and high) to the ground terminal turns the carbonator pump 144 off. No continuity from both electrode terminals (low and high) to the ground terminal turns the carbonator pump 144 on. Therefore, one purpose of the low electrode is to prevent short cycling of carbonator pump 144 because it is not activated until the carbonated water level falls below the low electrode.

The $CO_2$ pressure pushes the carbonated water out of carbonator tank 141 through a pick up tube 164 and into a closed loop beverage conduit 166 having a cooling coil section 168 of serpentine configuration immersed in the cooling fluid 101 for the purpose of chilling the carbonated water flowing through cooling coil 168. The carbonated water travels from the carbonator tank 141 to a liquid dispenser 170 such as a syrup dispenser (via the cooling coil 168, beverage conduit 166, and a circulating pump 172) for providing the carbonated water to be dispensed as the beverage. It is understood that dispenser 170 is of the type known in the art for dispensing beverages. The circulating pump 172 circulates the carbonated water within the closed loop beverage conduit 166 to provide a continuous supply of carbonated water to the dispenser. Carbonated water not dispensed at the dispenser 170 passes through a turn-around manifold (not shown) located at the dispenser 170. A returning beverage conduit 174 connected to the outlet end of the turn-around manifold returns the undispensed carbonated water to the beginning of cooling coil 168 completing the closed loop beverage conduit 166. Carbonated water returning from the dispenser 170 mixes with the newly manufactured carbonated water forced out of carbonator tank 141 to replenish the supply to dispenser 170. This allows carbonated water to flow from carbonator tank 141 to dispenser 170 and back, maintaining a constant beverage temperature throughout the system.

A water supply pressure sensor 112, connected to controller 106 and located either at water supply 142 or at beverage conduit 148, senses the water supply pressure at all times and generates a signal representative of the water supply pressure to the controller. The controller 106 compares the signal generated from the water supply pressure sensor 112 with a reference signal which indicates a predetermined minimum acceptable pressure. When the water supply pressure sensor indicates the water supply pressure is below the minimum acceptable pressure, the controller 106 discontinues the operation of beverage dispensing system 102. Controller 106 causes diagnostic message display 108 to display an error code E1 indicating the low water supply pressure.

A carbonator pump sensor 114 is connected to controller 106 and located at driver module 206 or 208 and senses the operation of driver. When sensor 114 indicates the inoperation or improper operation of driver, controller 106 displays an error code. In particular, diagnostic message display 108 is caused to display an error code E4 or E5 indicating that the driver for the carbonator pump is not operating.

A circulation pump sensor 116 is connected to controller 106 and located at the driver module 210 and senses the operation of the driver for the circulation pump. When circulation pump sensor 116 indicates the inoperation or improper operation of driver, controller 106 displays an error code. In particular, diagnostic message display 108 is caused to display an error code E6 or E7 indicating circulation pump 172 is not working.

The beverage dispensing system 102 may contain an agitator 176 immersed in the cooling fluid 101 located in cooling tank 100 for agitating the cooling fluid 101. An agitator sensor 118 which senses voltage supplied from the driver to the agitator is connected to controller 106 and located at driver module 212. It senses the operation of the agitator. When agitator sensor 118 generates a signal representative of the inoperation or improper operation of agitator 176 to controller 106, the controller displays an error code. In particular, diagnostic message display 108 is caused to display an error code E8 indicating driver for agitator 176 is not operating. Alternatively, driver module 212 may be configured to drive circulator B.

A temperature sensor 124, connected to controller 106 and located at the closed loop beverage conduit 166, senses a temperature of the carbonated water within beverage conduit 166. The temperature sensor 124 provides a signal to the controller 106 representative of the sensed temperature. Controller 106 responds to temperature sensor 124 and controls diagnostic message display 108 so that the diagnostic message display 108 displays the temperature corresponding to the temperature of the carbonated water within the loop.

Beverage dispensing system 102 may be a dual system and include a second carbonator pump 144B (see FIG. 2) connected to a second carbonator tank 141B, wherein the beverage conduit to the dispenser 170 comprises first and second loops such as beverage conduit loop 166 and first and second circulating pumps such as circulating pump 172 for circulating the carbonated beverages within the loops. Sensors 114A and 114B such as carbonator pump sensor 114 and sensors 116A and 116B such as circulator pump sensor 116, located at the carbonator pumps 144A and 144B and circulator pumps 172A and 172B, respectively, sense the operation of one or both of the carbonators and/or circulating pumps. Controller 106 inhibits operation of refrigeration system 104 and/or beverage dispensing system 102 in the event that one or more of sensors 114A, 114B, 116A, and 116B indicate the improper operation of the carbonators and/or circulating pumps.

Figure 2:
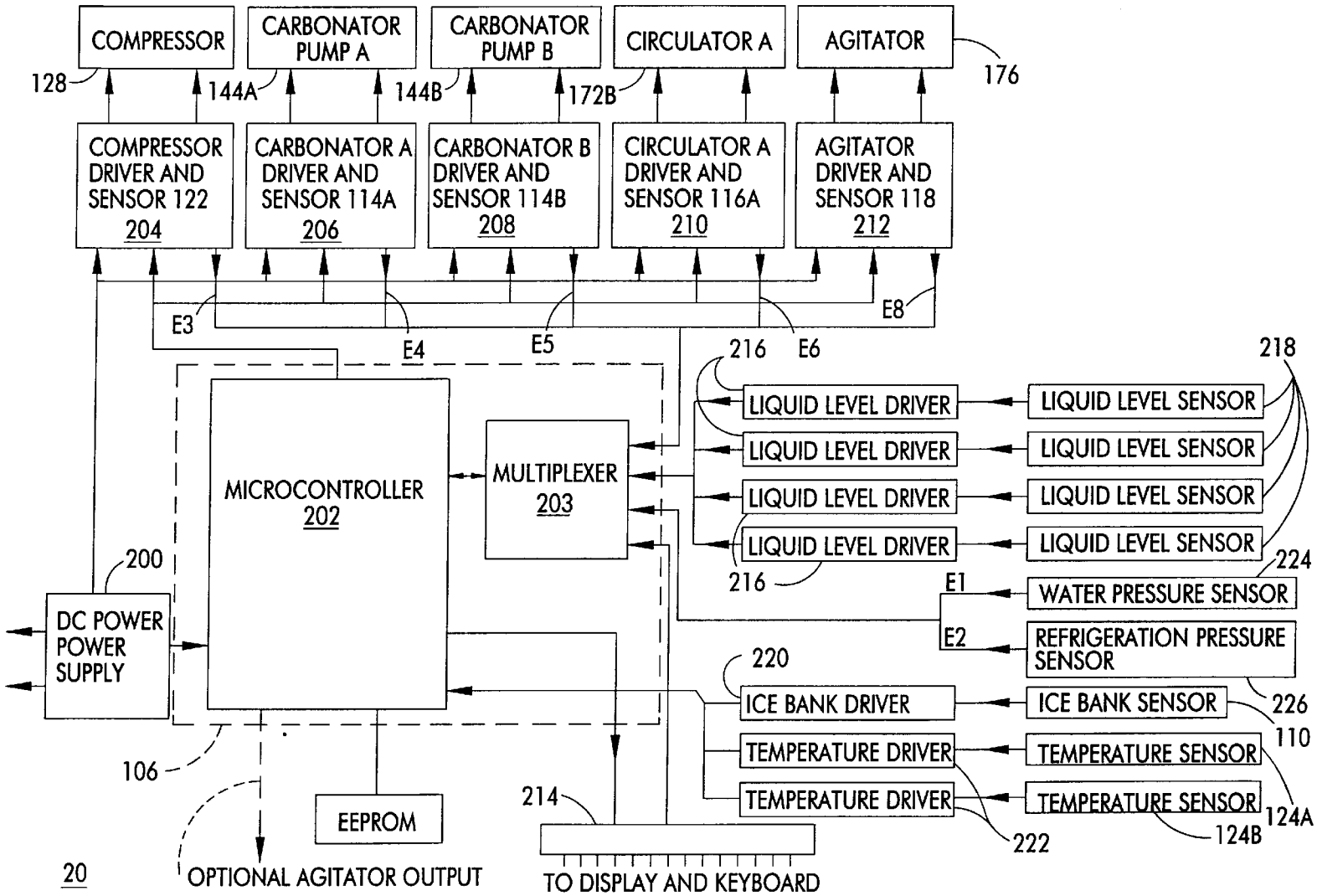
FIG. 2 is a block diagram of electrical components of the beverage system of FIG. 1 according to the invention.

FIG. 2 illustrates a block diagram of a mother board 20 of the system of FIG. 1 according to the invention. In the preferred embodiment of FIG. 2, beverage dispensing system 102 contains two carbonator pumps (carbonator pump A 144A and carbonator pump B 144B) and one circulator 172. It is understood that a second beverage conduit loop such as beverage conduit loop 166 with a circulator pump such as circulator pump 172 may be added with a second circulator driver such as circulator driver 210.

The mother board 20 contains a power supply 200, a controller 106, analog and digital inputs, and digital outputs. In one embodiment, controller 106 consists of a microcontroller 202 (MC68705P9) and multiplexer 203 wherein the microcontroller 202 incorporates a microprocessor and memory (not shown), and includes communication and other computer support functions. It is understood that controllers of other configurations known in the art may be used in the alternative. Controller 106 controls a compressor driver module 204 for driving a compressor 128 and four motor driver modules 206, 208, 210, and 212 for driving carbonator pump A 144A, carbonator pump B 144B, circulator pump 172, and an agitator 176, respectively. Agitator driver 212 may be configured as a circulator B driver for larger systems and, in either case, its voltage sensor 212 monitors the driver operation. Microcontroller may be provided with an additional output for larger systems to drive an agitator. The power supply 200 services the low voltage microprocessor circuit, inputs, and the high voltage outputs. The compressor driver module 204 and the four motor driver modules 206, 208, 210, and 212 are connected to the mother board 20 through 10 pin connectors. The controller 106 also controls the diagnostic message display 108, shown in detail in FIG. 6A, which is connected to the mother board 20 by a 14 pin ribbon cable 214.

Four liquid level drivers 216 are connected to four liquid level sensors 218, such as electrodes 162A and 162B (two per tank). The system may contain a single carbonator pump 144 connected to a single carbonator tank 141 with two liquid level sensors 218, or a dual carbonator system with two carbonator pumps 144A and 144B and two carbonator tanks 141A and 141B with two liquid level sensors 218 per carbonator tank. Inputs from the liquid level sensors 218 to controller 108 determine when carbonator pump A 144A and carbonator pump B 144B will be turned on and off by controller 106 to control the liquid level in the carbonator tanks 141A and 141B.

An ice bank driver 220 connects to ice bank thickness sensor 110 located adjacent evaporator 126 shown in FIG. 1. The ice bank thickness sensor 110 generates a signal provided to controller 106 representative of the ice bank thickness. The controller 106 turns off the refrigeration system 104 when the ice bank thickness sensor 110 indicates the ice bank build up is too high (as compared by the controller with a predetermined acceptable amount of ice).

The mother board 20 contains two temperature drivers 222 connected to two temperature sensors 124. The temperature sensors 124 sense the temperature of the circulating carbonated liquid in one or more beverage conduits such as closed loop beverage conduit 166 shown in FIG. 1. The temperature sensors 124 drive controller 106 for output display of the sensed circulating carbonated liquid temperature(s) on diagnostic message display 108.

A low liquid pressure switch 224 determines when the controller 106 will shut down the motors for safety due to unacceptable low water supply pressure detected by condition sensor 112. A high pressure refrigeration switch 226 determines when the controller 106 will shut down the motors for safety due to unacceptable high refrigeration pressure detected by condition sensor 120.

Figure 3C:
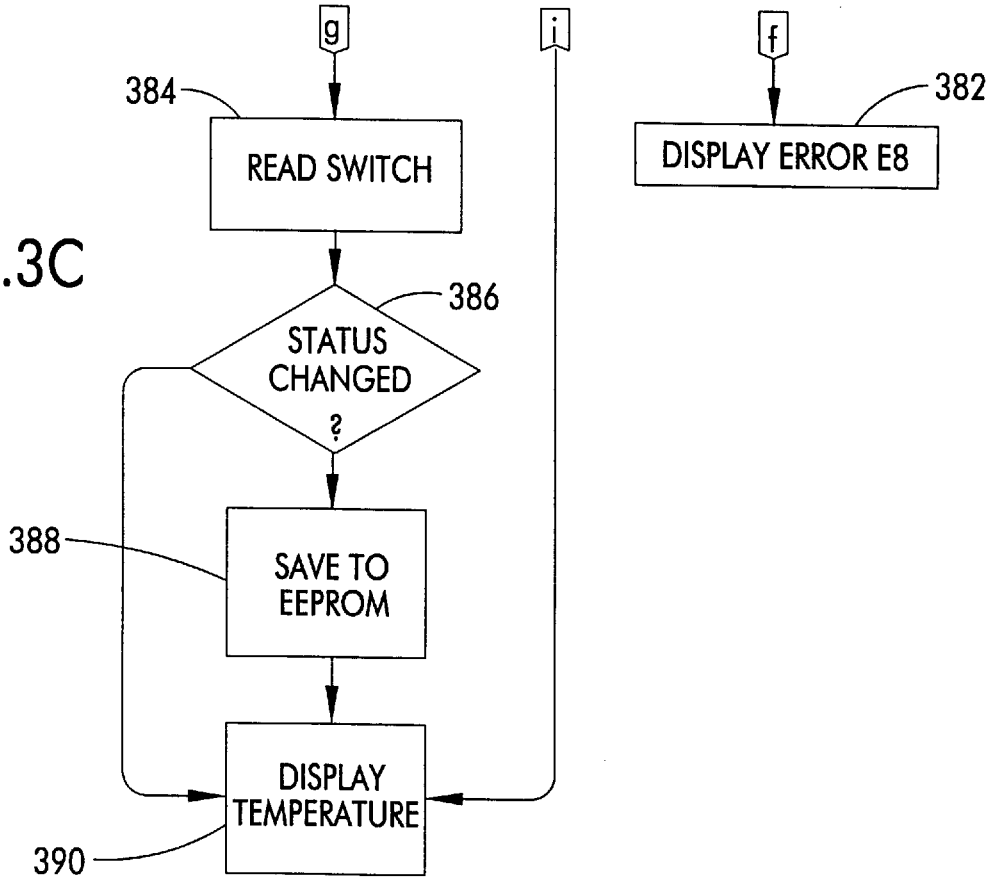

FIGS. 3A, 3B, and 3C depict a flow chart illustrating the operation of the controller 106 of the beverage cooling and dispensing system with diagnostics according to the invention. Initially, the software causes the controller 106 to execute step 300 to turn on the system. Step 302 loads the switch status from an EEPROM connected to the microcrontroller (see FIG. 2) and displays the status on diagnostic message display 108. Step 304 begins a start up cycle by counting down from three minutes and displays the count down on diagnostic message display 108.

Step 306 determines if the water pressure from water supply 142 is too low as sensed by pressure sensor 112. If the water pressure is too low, step 308 displays an error code E1 on diagnostic message display 108 which indicates low water supply pressure. If the water pressure is not low, step 310 then determines if the refrigeration pressure is too high as sensed by pressure sensor 120. If the refrigeration pressure is too high, step 312 displays an error code E2 on diagnostic message display 108 to indicate high refrigeration pressure. If the refrigeration pressure is not high, the operation continues to step 314.

Step 314 determines if a compressor switch 602 (See FIG. 6) is on. If compressor switch 602 is not on, step 316 turns compressor 128 off and the operation continues to step 336. If compressor switch 602 is on, step 318 then determines if ice bank sensor 110 is open, indicating sufficient ice build up. If ice bank sensor 110 is open, step 320 turns off compressor 128. If ice bank sensor 110 is not open, indicating insufficient ice, step 322 then determines if there is high refrigeration pressure as sensed by condition sensor 120. If there is high refrigeration pressure, step 324 turns compressor 128 off and the controller operation continues to step 336. If there is insufficient ice and high refrigeration pressure, step 326 turns compressor 128 on and then step 328 determines whether the three minute delay is at zero. If the delay is not at zero, step 330 displays the delay on diagnostic message display 108 until it is at zero. If the delay is at zero or when the delay reaches zero, the operation then continues to step 332.

Step 332 determines if any action has been taken prior to steps 320 or 324. If no action has been taken, step 334 displays an error code E3 on diagnostic message display 108 to indicate that compressor 128 is not operating. If action has been taken, then the operation continues to step 336 which determines if carbonator switch A 602 (See FIG. 6) is on. If the switch is not on, step 338 turns the carbonator A motor (not shown) off and the operation continues to step 350. If carbonator A switch 602 is on, step 340 then determines if the liquid level in carbonator tank A 141A is high. Continuing on FIG. 3B, if the liquid level is too high, step 342 turns the carbonator A motor off and if the liquid level is not too high, step 344 turns the carbonator A motor on. Step 346 then determines if any action has been taken prior to steps 342 or 344. If no action has been taken, step 348 displays an error code E4 on diagnostic message display 108 to indicate that liquid level in carbonator tank A 141A is too high. If action has been taken, the operation of controller 106 continues to step 350.

Step 350 determines if a carbonator switch B 602 (See FIG. 6) is on. If the switch is not on, step 352 turns the carbonator pump B motor (not shown) off and the operation continues to step 364. If carbonator B switch 602 is on, step 354 then determines if the liquid level in carbonator tank B 141B is high. If the liquid level is too high, step 356 turns the carbonator pump B motor off and if the liquid level is not too high, step 358 turns the carbonator pump B motor on. Step 360 then determines if any action has been taken prior to steps 356 or 358. If no action has been taken, step 362 displays an error code E5 on diagnostic message display 108 to indicate that the liquid level in carbonator tank B 141B is too high. If action has been taken, the operation continues to step 364.

Step 364 determines if a circulator switch 602 (See FIG. 6) is on. If the switch is on, step 366 turns the circulator motor (not shown) on. If switch 602 is off, step 368 turns the circulator motor off. If no action has been taken prior to steps 366 and 368, as determined by step 370, step 372 displays an error code E6 on diagnostic message display 108 to indicate the inoperation of circulator pump 172. A second circulator pump may be used in the system and would follow the same operation for determining if circulator pump B switch 602 is on, and then turning the circulator pump B motor on if the switch is on, or turning the circulator pump B motor off is the switch in not on. If no action has been taken, an error code E7 would be displayed to indicate that circulator pump B 172B is not operating.

If action has been taken prior to steps 366 or 368, as determined in step 370, step 374 then determines if an agitator switch 602 (See FIG. 6) is on. If the agitator switch 602 is not on, step 376 turns the agitator motor (not shown) off. If the agitator switch 602 is on, step 378 turns the agitator motor on. Step 380 then determines if any action has been taken. If no action has been taken, step 382 displays an error code E8 on diagnostic message display 108 to indicate the inoperation of agitator 176.

Continuing to FIG. 3C, if action has been taken, step 384 reads the switches 602 (See FIG. 6) and step 386 determines if the switch status has changed. If the switch status changed, step 388 saves the new status to the EEPROM (not shown). Step 390 displays the temperature as sensed by the temperature sensor 124 on diagnostic message display 108 whether the switch status is changed or not. The operation then returns to step 306 and repeats.

Figure 4:
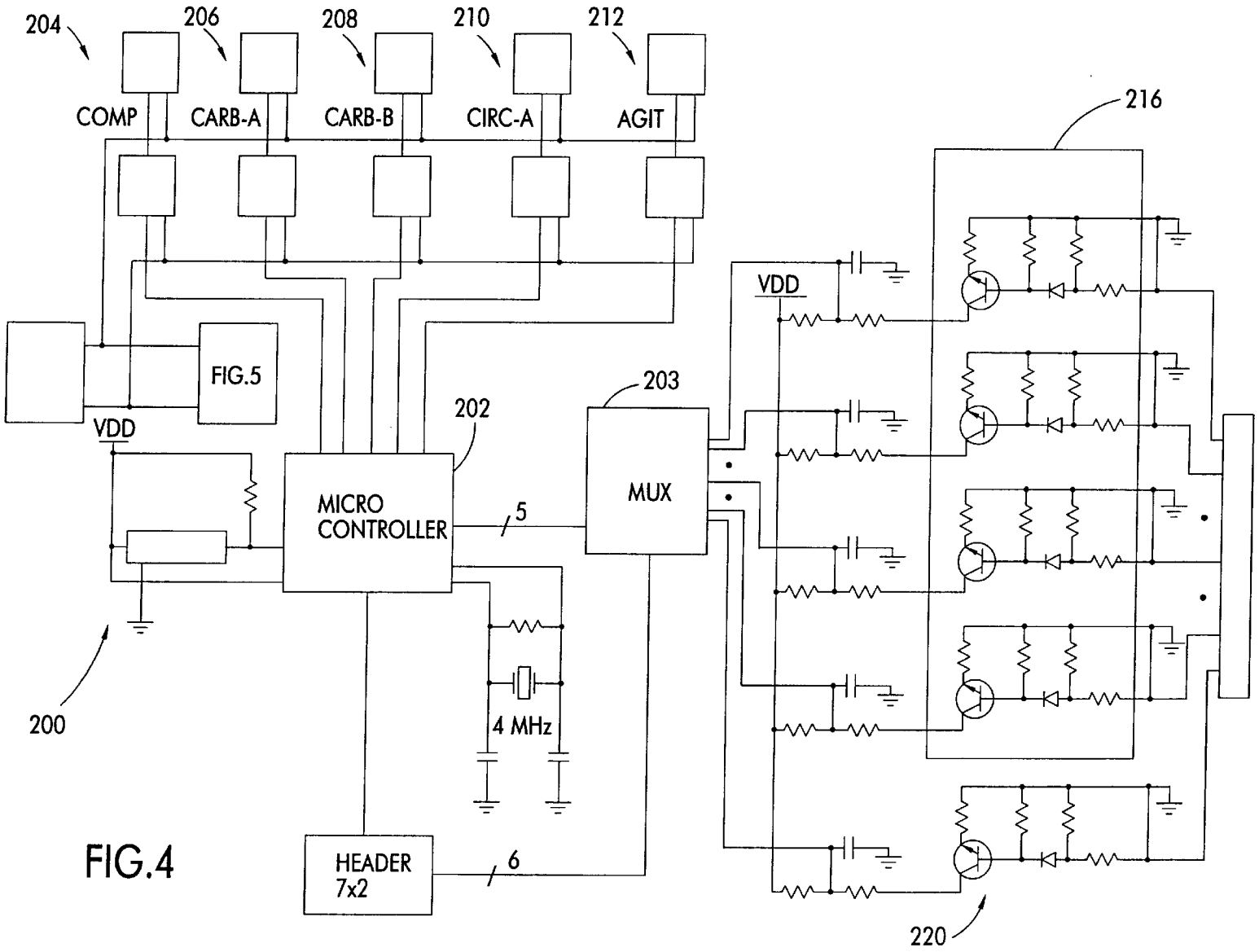
FIG. 4 is a schematic diagram of the printed circuit control board for the system with diagnostics according to the invention.

FIG. 4 shows a schematic diagram further detailing the printed circuit control board of FIG. 2. The control board contains the power supply 200, the microcontroller 202, and the multiplexer 203. It is understood that alternative controllers may be used in place of microcontroller 202 and multiplexer 203. The control board also contains the compressor driver 204 and the four motor drivers 206, 208, 210, and 212 for driving carbonator pump A 144A, carbonator pump B 144B, a circulator pump 172, and an agitator, 176 respectively. Four liquid level drivers 216 drive liquid level sensors 218 (See FIG. 2). Ice bank sensor driver 220 drives ice bank sensor 110 which senses the amount of ice build-up on evaporator 126.

Figure 5:
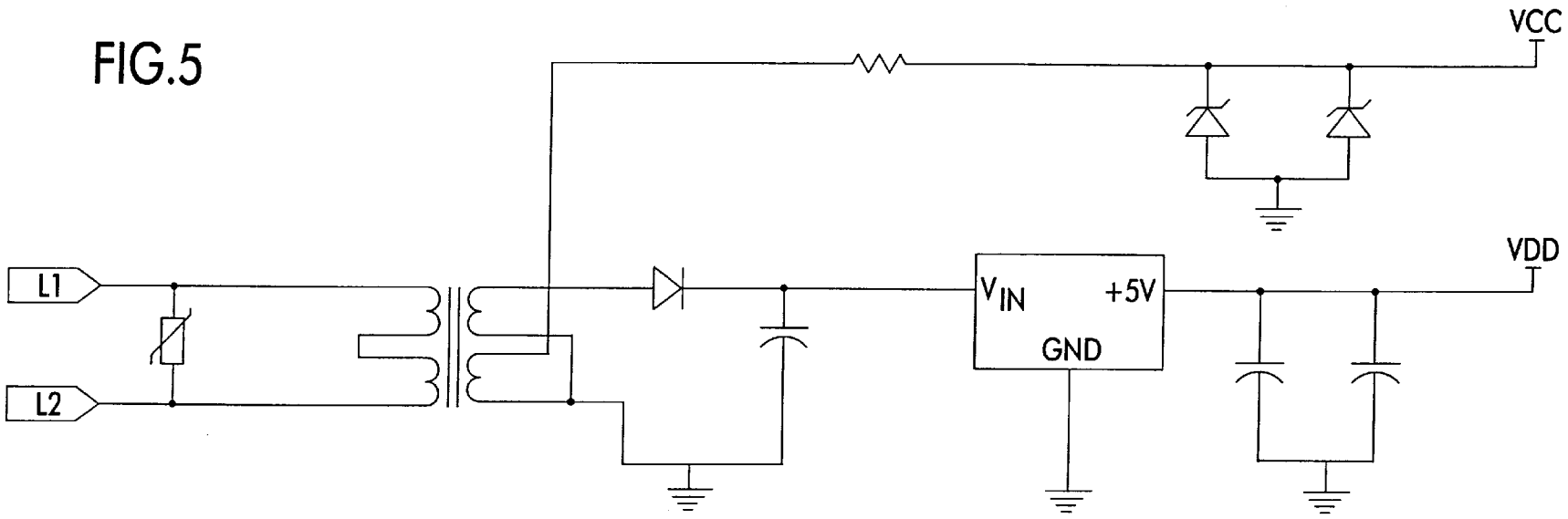
FIG. 5 is a schematic diagram of the printed circuit power supply for the system with diagnostics according to the invention.

FIG. 5 shows a schematic diagram of the printed circuit power supply for the system with diagnostics according to the invention.

Figure 6A:
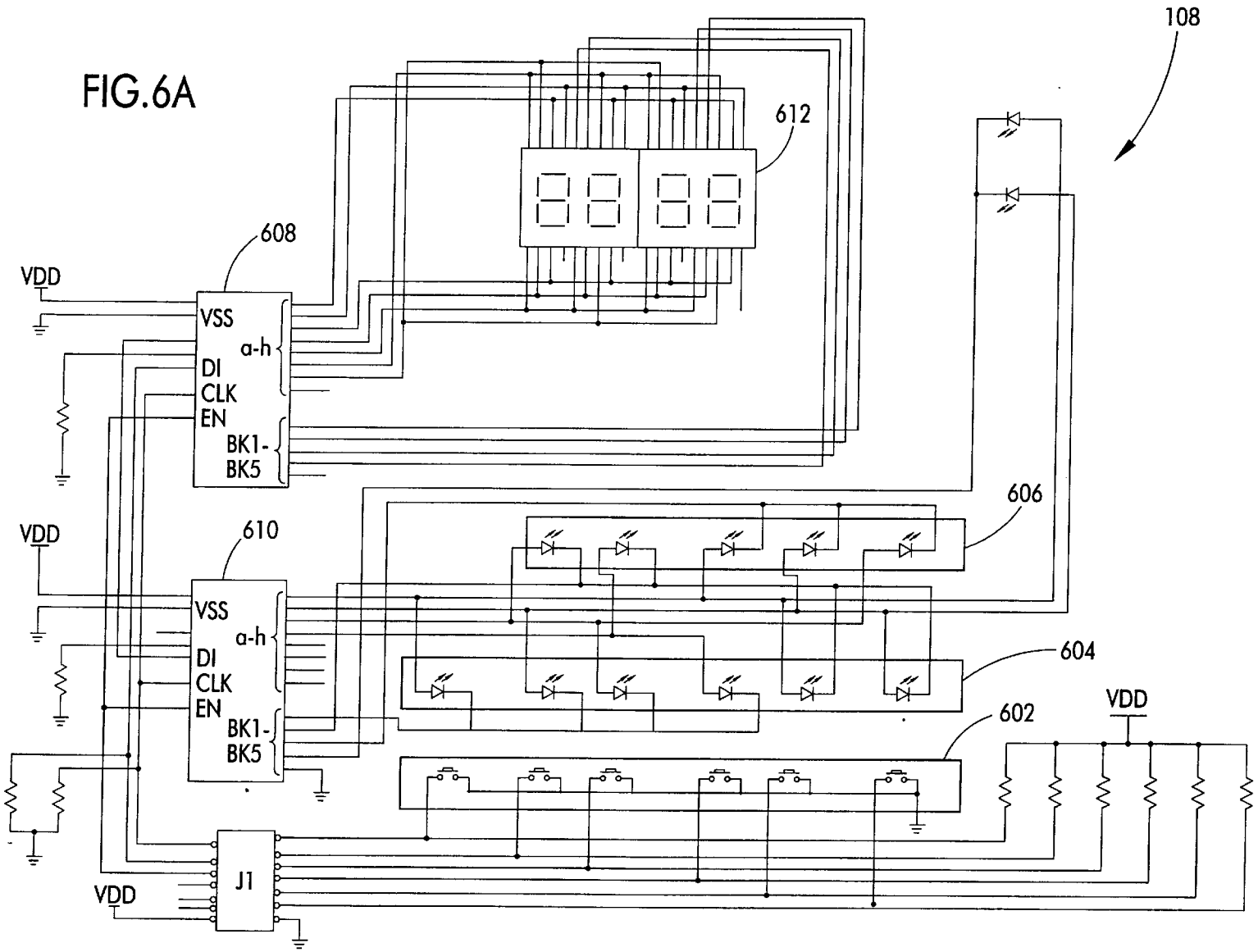
FIG. 6A is a schematic diagram of the printed circuit board for a keyboard and display for the system with diagnostics according to the invention.

FIG. 6A shows a schematic diagram of the printed circuit board for diagnostic message display 108 for the system with diagnostics according to the invention. In a preferred embodiment, diagnostic message display 108 consists six on/off switches 602 which manually control the operation of the agitator, compressor, carbonator(s) and circulator(s). Display also includes six red LED's 604 corresponding to the switches and indicating on/off status of the switches. It is the status of these switches which is stored in the EEPROM. This allows the controller to recover and continue system operation after a power outage.

Figure 6B:
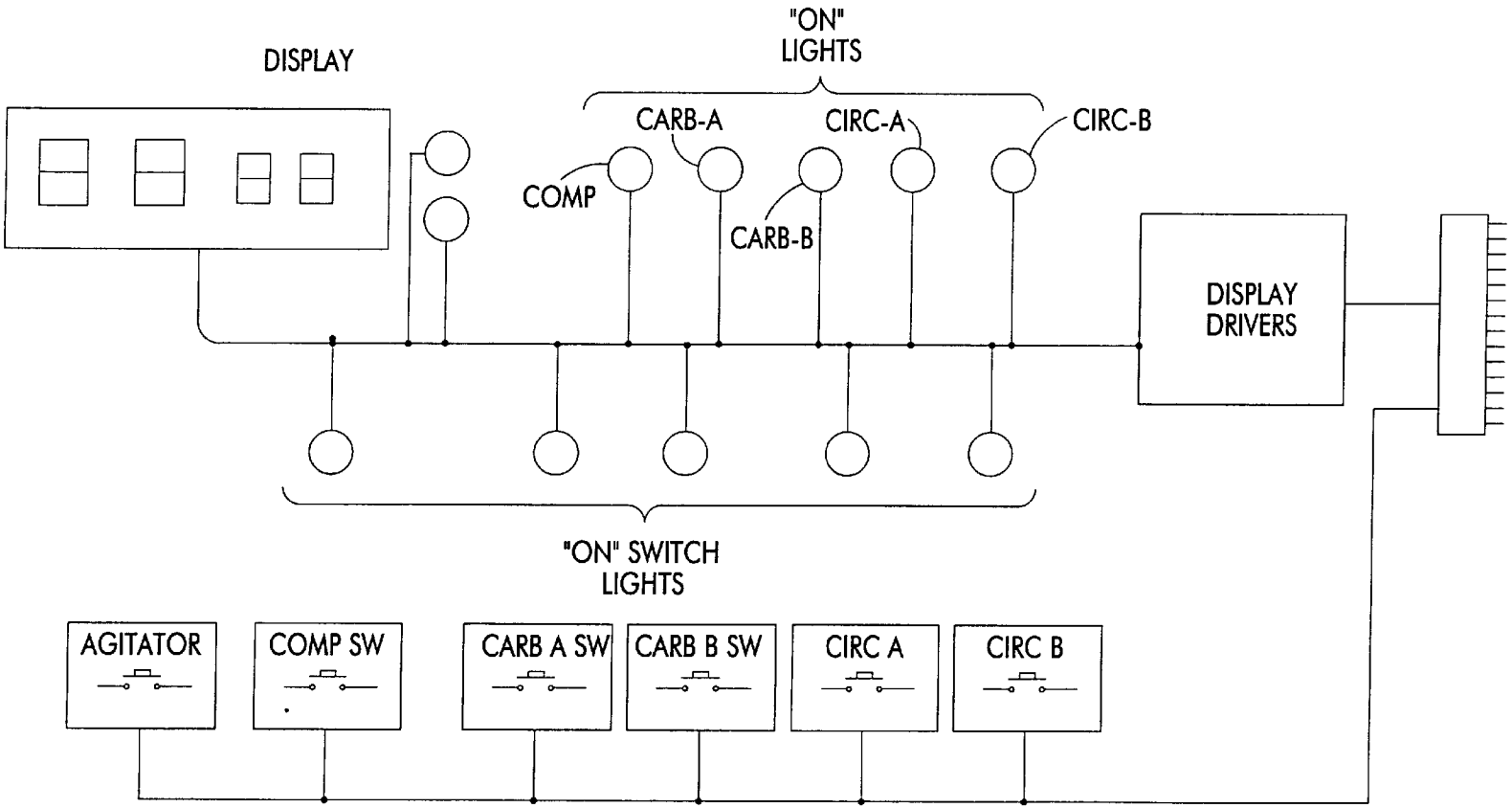
FIG. 6B is a block diagram of one preferred embodiment of the display and keyboard according to the invention.

The display also includes five green LED's 606 which indicate motor status and are generally illuminated when the motors are operating. The display also includes display drivers 608 for driving a four-digit seven segment numeric display 612. A driver 610 drives the LEDs. In the alternative, numeric display 612 may display more than four digits. The six on/off switches 602 correspond to agitator 176, compressor 128, carbonator pump A 144A, carbonator pump B 144B and circulator pump A 172A and circulator pump B 172B. The diagnostic message display 108 displays the error codes. The diagnostic message display 108 also displays the temperature, in fahrenheit or centigrade, on numeric display 612 as determined from temperature sensor 124. When a diagnostic error occurs, diagnostic message display 108 displays the error code, or multiple error codes will be toggled, on numeric display 612 until the error is corrected. FIG. 6B illustrates one preferred embodiment of the display according to the invention.

Figure 7:
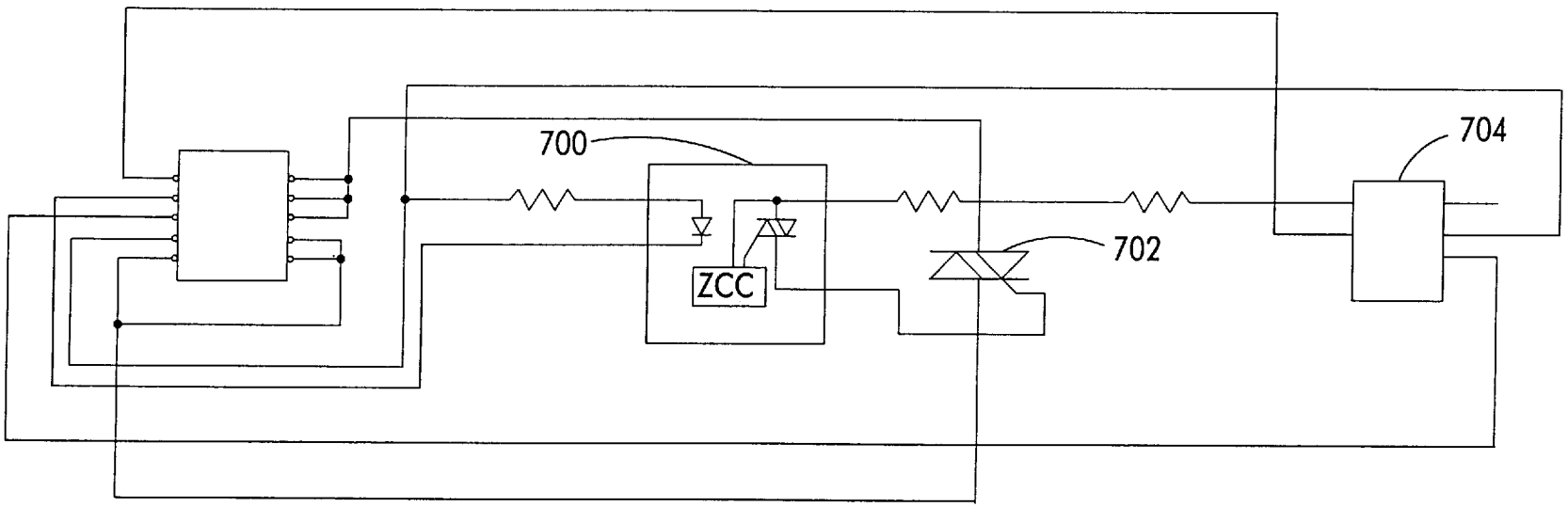
FIG. 7 is a schematic diagram of the printed circuit motor control board for the system with diagnostics according to the invention.

FIG. 7 shows a schematic diagram of the printed circuit motor control board. The motor control board contains a zero-crossing optoisolator 700, a triac 702, and a voltage sensor 704 which correspond sensors 114A, 114B, 116 and 118. The zero optoisolator 700 isolates high voltage and low voltage and zero switches the triac 702. The triac 702 turns on and off the motor (not shown in this FIG. 7). The voltage sensor 704 senses the voltage applied to the motor and generates a corresponding low voltage signal which is provided as a feedback signal to the controller 106.

Figure 8:
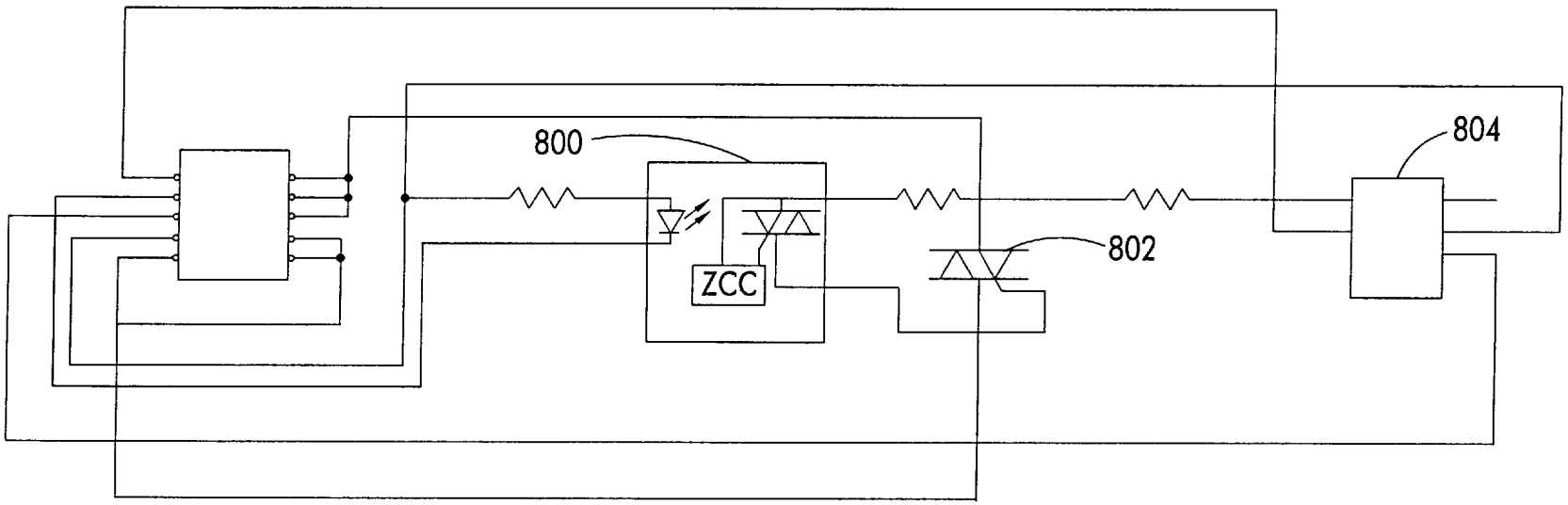
FIG. 8 is a schematic diagram of the printed circuit compressor control board and display for the system with diagnostics according to the invention.

FIG. 8 shows a schematic diagram of the printed circuit compressor control board. The compressor control board contains a zero-crossing optoisolator 800, a triac 802, and a voltage sensor 804 which corresponds to sensor 122. The zero optoisolator 800 isolates high voltage and low voltage and zero switches the triac 802. The triac 802 turns on and off the compressor 128. The voltage sensor 804 senses the voltage applied to the compressor 128 and generates a corresponding low voltage signal which is provided as a feedback signal to the controller 106.

What is claimed is:

1. A cooling/dispensing system for cooling and dispensing a beverage comprising:

a cooling tank for holding a fluid;

a refrigeration system having an evaporator in the cooling tank for cooling the fluid in the tank and having a compressor connected to the evaporator for cooling the evaporator;

a beverage dispensing system including:

a carbonator tank in heat exchange relationship with the fluid in the cooling tank, the carbonator having a first input port connected to a gas supply, having a second input port connected to a liquid supply and having a output port, the carbonator for carbonating the liquid from the liquid supply flowing through the carbonator to produce a carbonated liquid product;

a dispenser for dispensing the beverage;

a beverage conduit connected to the output of the carbonator and connected to the dispenser for providing the carbonated liquid product to be dispensed as the beverage; and a pump including a driver;

a condition sensor sensing a condition of the pump driver;

a controller responsive to the condition sensor for enabling operation of the refrigeration system and the beverage dispensing system during periods when the condition sensor indicates that the sensed condition is acceptable, said controller inhibiting operation of the refrigeration system and the beverage dispensing system during periods when the condition sensor indicates that the sensed condition is unacceptable; and a diagnostic message display connected to the controller for displaying an error message when a sensed condition is unacceptable.

2. The system of claim 1 further comprising a second condition sensor sensing a second condition of the refrigeration system or the beverage dispensing apparatus and wherein controller controls the display so that the error message displayed by the diagnostic message display indicates the unacceptable sensed condition corresponding to the error message.

3. The system of claim 1 wherein the controller controls the display so that the error message displayed by the diagnostic message display indicates the unacceptable sensed condition corresponding to the error message.

4. The system of claim 1 wherein the beverage conduit comprises a closed loop, wherein the pump comprises a circulating pump for circulating the carbonated liquid within the loop and further comprising a loop temperature sensor for sensing a temperature corresponding to a temperature of the carbonated liquid within the loop and wherein the controller is responsive to the loop temperature sensor to control the display so that the temperature corresponding to the temperature of the carbonated liquid within the loop is displayed.

5. The system of claim 1 wherein the beverage conduit comprises a closed loop, wherein the pump comprises a circulating pump for circulating the carbonated liquid within the loop, wherein the condition sensor comprises a sensor for sensing the operation of a driver of the circulating pump and wherein the controller displays an error code in the event that the circulating pump driver is inoperative.

6. The system of claim 1 wherein the condition sensor comprises a pressure sensor for sensing the pressure of the liquid supply and/or the pressure of the refrigeration system and wherein the controller inhibits operation of the refrigeration system and the beverage dispensing system in the event that either or both of the sensed pressures is below a minimum.

7. The system of claim 1 wherein the condition sensor comprises a sensor for sensing operation of a driver of the compressor and/or a driver of the carbonator and wherein the controller displays an error code in the event that the compressor driver and/or the carbonator driver is inoperative.

8. The system of claim 1 further comprising an agitator for agitating the fluid and wherein the condition sensor comprises a sensor for sensing the operation of a driver of the agitator and wherein the controller displays an error code in the event that the agitator driver is inoperative.

9. The system of claim 1 wherein the beverage dispensing system includes a second carbonator, wherein the beverage conduit comprises first and second loops, wherein the pump comprises first and second circulating pumps for circulating the carbonated beverages within the loops, wherein the sensor senses operation of one or more the drivers of the carbonators and/or the circulating pumps and wherein the controller displays an error code in the event that one or more of the drivers of the carbonators and circulating pumps is inoperative.

10. The system of claim 1 wherein the pump is a carbonator pump for pumping the liquid from the liquid supply into the carbonator tank.

11. The system of claim 1 wherein the pump is a circulator pump for circulating the carbonated liquid product within the beverage conduit.

12. The system of claim 1 wherein the pump is an agitator for agitating the fluid in the cooling tank.

13. The system of claim 1 wherein the diagnostic message display is an alphanumeric display that displays an indication that the sensed condition of the pump is unacceptable.

14. A cooling/dispensing system for cooling and dispensing a beverage comprising:

a cooling tank for holding a fluid;

a refrigeration system having an evaporator in the cooling tank for cooling the fluid in the tank and having a compressor connected to the evaporator for cooling the evaporator;

a beverage dispensing system including:

a carbonator in heat exchange relationship with the fluid in the cooling tank, the carbonator having a first input port connected to a gas supply, having a second input port connected to a liquid supply and having a output port, the carbonator for carbonating the liquid from the liquid supply flowing through the carbonator;

a dispenser for dispensing the beverage; and a beverage conduit connected to the output of the carbonator and connected to the dispenser for providing the carbonated liquid to be dispensed as the beverage;

a temperature sensor for sensing a temperature corresponding to a temperature of the carbonated liquid;

a condition sensor sensing a condition of the refrigeration system or of the beverage dispensing apparatus;

a controller responsive to the temperature sensor for indicating a numeric temperature of the carbonated liquid, said controller responsive to the condition sensor for enabling operation the refrigeration system and the beverage dispensing system during periods when the condition sensor indicates that the sensed condition is acceptable, said controller inhibiting operation of the refrigeration system and the beverage dispensing system during periods when the condition sensor indicates that the sensed condition is unacceptable; and an alphanumeric diagnostic message display connected to the controller for displaying an alphanumeric error message indicating the unacceptable sensed condition or for displaying the numeric temperature.

15. A cooling/dispensing system for cooling and dispensing a beverage comprising:

a cooling tank for holding a fluid;

a refrigeration system having an evaporator in the cooling tank for cooling the fluid in the tank and having a compressor connected to the evaporator for cooling the evaporator;

a beverage dispensing system including:

a carbonator in heat exchange relationship with the fluid in the cooling tank, the carbonator having a first input port connected to a gas supply, having a second input port connected to a liquid supply and having a output port, the carbonator for carbonating the liquid from the liquid supply flowing through the carbonator;

a dispenser for dispensing the beverage;

a beverage conduit connected to the output of the carbonator and connected to the dispenser for providing the carbonated liquid to be dispensed as the beverage;

a pump; and a pump driver for selectively operating the pump;

a condition sensor for sensing a condition of the pump driver;

a controller responsive to the condition sensor for enabling operation of the refrigeration system and the beverage dispensing system during periods when the condition sensor indicates that the sensed condition is acceptable, said controller inhibiting operation of the refrigeration system and the beverage dispensing system during periods when the condition sensor indications that the sensed condition is unacceptable; and a diagnostic message display connected to the controller for providing a display indicating that the condition of the pump driver is unacceptable.

16. The system of claim 15 wherein each driver is in a separate module.

17. The system of claim 15 wherein the controller and display are enclosed in a water resistant enclosure.

18. The system of claim 15 wherein the pump is a carbonator pump for pumping the liquid from the liquid supply into the carbonator tank.

19. The system of claim 15 wherein the pump is a circulator pump for circulating the carbonated liquid product within the beverage conduit.

20. The system of claim 15 wherein the pump is an agitator for agitating the fluid in the cooling tank.

* * * * *